US006803881B2

(12) United States Patent
Ishihara et al.

(10) Patent No.: US 6,803,881 B2
(45) Date of Patent: Oct. 12, 2004

(54) ANTENNA UNIT AND COMMUNICATION DEVICE INCLUDING SAME

(75) Inventors: Takashi Ishihara, Machida (JP); Syoji Nagumo, Sagamihara (JP); Kazunari Kawahata, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/464,766

(22) Filed: Jun. 19, 2003

(65) Prior Publication Data

US 2004/0036653 A1 Feb. 26, 2004

(30) Foreign Application Priority Data

Aug. 23, 2002 (JP) ..... 2002-243900

(51) Int. Cl.[7] ..... H01Q 1/38
(52) U.S. Cl. ..... 343/700 MS; 343/702
(58) Field of Search ..... 343/700 MS, 702

(56) References Cited

U.S. PATENT DOCUMENTS 6,614,398 B2 * 9/2003 Kushihi et al. ..... 343/700 MS
6,639,559 B2 * 10/2003 Okabe et al. ..... 343/700 MS

FOREIGN PATENT DOCUMENTS

| | | |
|---|---|---|
| JP | 2000-151258 | 5/2000 |
| JP | 3246440 | 11/2001 |

* cited by examiner

*Primary Examiner*—Michael C. Wimer
(74) *Attorney, Agent, or Firm*—Keating & Bennett, LLP

(57) ABSTRACT

An antenna unit includes an antenna body having a fed radiation electrode and a non-fed radiation electrode that generate a double resonance state and that are mounted on a dielectric substrate, and a substrate for mounting the antenna body thereon. A ground electrode is disposed on the substrate in a predetermined area other than a ground-electrodeless portion provided on the substrate. The ground-electrodeless portion extends from at least one portion of an antenna-body mounting area so as to extend off of and away from the antenna-body mounting area. Grounding ends of the fed radiation electrode and the non-fed radiation electrode are connected to the ground electrode via grounding lines disposed on a predetermined portion of the ground-electrodeless portion, the predetermined portion being outside the antenna-body mounting area.

20 Claims, 12 Drawing Sheets

ANTENNA UNIT AND COMMUNICATION DEVICE INCLUDING SAME

BACKGROUND OF THE INVENTION

1. Field of the Invention

The present invention relates to an antenna unit that can be used for a communication terminal or other suitable device and further relates to a communication device including such an antenna unit.

2. Description of the Related Art

FIG. 12 is a schematic perspective view of an antenna 20 provided in a communication device. This antenna 20 has a dielectric substrate 21, a fed radiation electrode 22 and a non-fed radiation electrode 23 that are mounted on the dielectric substrate 21, a feed electrode (not shown) that is located on a predetermined side surface of the dielectric substrate 21 and that feeds the fed radiation electrode 22 a signal, and an antenna-grounding electrode (not shown) disposed on the entire lower surface of the dielectric substrate 21.

The fed radiation electrode 22 has two ends. One of the two ends is a grounding end 22*a* and the other of the two ends is a feed end that is fed a signal transmitted from the feeding electrode. The non-fed radiation electrode 23 has two ends. One of the two ends is a grounding end 23*a* and the other of the two ends is an open end.

This antenna 20 is surface-mounted on a ground electrode 26 of a circuit substrate 25 of the communication device. Subsequently, the feed electrode is connected to a signal feeder 27 of the circuit substrate 25. The grounding ends 22*a* and 23*a* are directly connected to the ground electrode 26.

In this case, for example, when the signal feeder 27 transmits a signal for communications to the feed electrode of the antenna 20, the feeding electrode transmits the signal to the fed radiation electrode 22. The signal is further transmitted from the fed radiation electrode 22 to the non-fed radiation electrode 23 by electromagnetic coupling therebetween, whereby the fed radiation electrode 22 and the non-fed radiation electrode 23 resonate and perform an antenna operation.

The fed radiation electrode 22 and the non-fed radiation electrode 23 can generate a double-resonance state when various conditions such as the electrical lengths of the fed radiation electrode 22 and the non-fed radiation electrode 23, the distance therebetween, and so forth, are adjusted in an appropriate manner. This double-resonance state increases the characteristic of the antenna 20.

Recently, small and low-profile antennas have been demanded. However, the efficiency of the fed radiation electrode 22 and the non-fed radiation electrode decreases when the dielectric substrate 21 is made smaller and low-profiled. In this case, the characteristic of the antenna 20 is reduced.

SUMMARY OF THE INVENTION

In order to overcome the problems described above, preferred embodiments of the present invention provide an antenna unit that is miniaturized and low-profile without reducing the antenna efficiency thereof and a communication device including such an antenna unit.

According to a preferred embodiment of the present invention, an antenna unit for transmitting and receiving a predetermined radio wave includes an antenna body having a dielectric substrate and a fed radiation electrode with a first open end and a first grounding end. The fed radiation electrode is mounted on the dielectric substrate. The antenna body further has a non-fed radiation electrode with a second open end and a second grounding end. The non-fed radiation electrode is provided near the fed radiation electrode and mounted on the dielectric substrate. The antenna unit further includes a substrate for mounting the antenna body thereon. The substrate has a ground electrode thereon, a ground-electrodeless portion extending from at least one portion of an antenna-body mounting area so as to extend off of and away from the antenna-body mounting area, and at least one grounding line disposed on a predetermined area of the ground-electrodeless portion. The predetermined area is outside the antenna-body mounting area. The fed radiation electrode is fed a signal transmitted from a signal feeder. Further, at least one of the first and second grounding ends is connected to the ground electrode via the grounding line.

According to the present preferred embodiment of the present invention, at least one of the grounding ends of the fed radiation electrode and the non-fed radiation electrode is connected to the ground electrode via the grounding line disposed on the predetermined area of the ground-electrodeless portion, the predetermined area being outside the antenna-body mounting area on the ground electrode of the substrate. The grounding line can perform an antenna operation in concert with the fed radiation electrode and the non-fed radiation electrode, which means that an antenna is disposed outside the antenna body. Therefore, it becomes possible to increase the effective size of the antenna body without increasing the actual size thereof and the antenna efficiency.

Further, at least one portion of the antenna-body mounting area functions as a ground-electrodeless portion, which also increases the antenna efficiency. Therefore, preferred embodiments of the present invention can provide a small and low-profile antenna body without decreasing the antenna efficiency.

Further, when the grounding line extends in a predetermined direction crossing the direction along which currents of the fed radiation electrode and the non-fed radiation electrode pass, it becomes easy to independently control a polarized wave in the direction along which the currents pass and a polarized wave in the direction along which the grounding line extends. Therefore, the antenna unit can use a frequency band affected by the polarized wave in the direction along which the currents of the fed radiation electrode and the non-fed radiation electrode pass and a frequency band affected by the polarized wave in the direction along which the grounding line extends, whereby resonance frequencies within the different frequency bands can be adjusted independently. Since the resonance frequencies of the antenna unit can be easily adjusted, it becomes possible to cope with design modifications or other changes without delay.

The first and second grounding ends are disposed on one side surface of the dielectric substrate so as to be adjacent to each other over a predetermined distance, or on different side surfaces of the dielectric substrate, respectively. Further, both the first and second grounding ends are connected to the ground electrode via the grounding lines, respectively, and the grounding lines extend from the first and second grounding ends so as to be spaced away from each other and are connected to the ground electrode. According to the above-described configuration, the intensity of the polarized wave in the direction along which the grounding line extends increases. Therefore, it becomes possible to reduce the interaction of the polarized wave in the direction along which the currents of the fed radiation electrode and the non-fed radiation electrode pass, and the polarized wave in the direction along which the grounding line extends. Subsequently, it becomes easier to adjust the resonance frequencies of the different frequency bands of the antenna unit, respectively.

The ground-electrodeless portion is an area extending from the antenna-body mounting area to an edge portion of the substrate and at least one portion of a side edge of the grounding line is disposed on the edge portion of the substrate. According to the above-described configuration, it becomes possible to use the edge portion which is less suitable for mounting portions thereon and likely to be wasted. Therefore, it becomes possible to produce the antenna unit without reducing most of the effective area of the substrate for forming the elements and the pattern of traces thereon.

The communication device including the antenna unit is miniaturized since the antenna unit is miniaturized and becomes low profile. Further, the reliability of the communication device increases since the antenna efficiency increases.

Other features, elements, characteristics and advantages of the present invention will become more apparent from the following detail description of preferred embodiments thereof with reference to the attached drawings.

DETAILED DESCRIPTION OF PREFERRED EMBODIMENTS

Preferred embodiments of the present invention will now be described with reference to the drawings.

Figure 1A:
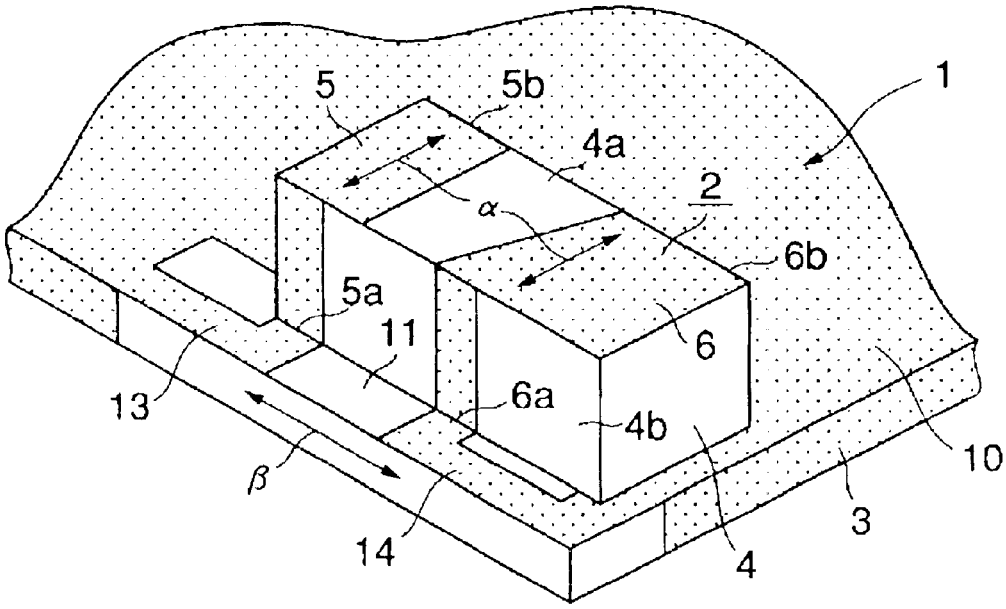
FIG. 1A is a perspective view of an antenna unit according to first and second preferred embodiments of the present invention.
Figure 1B:
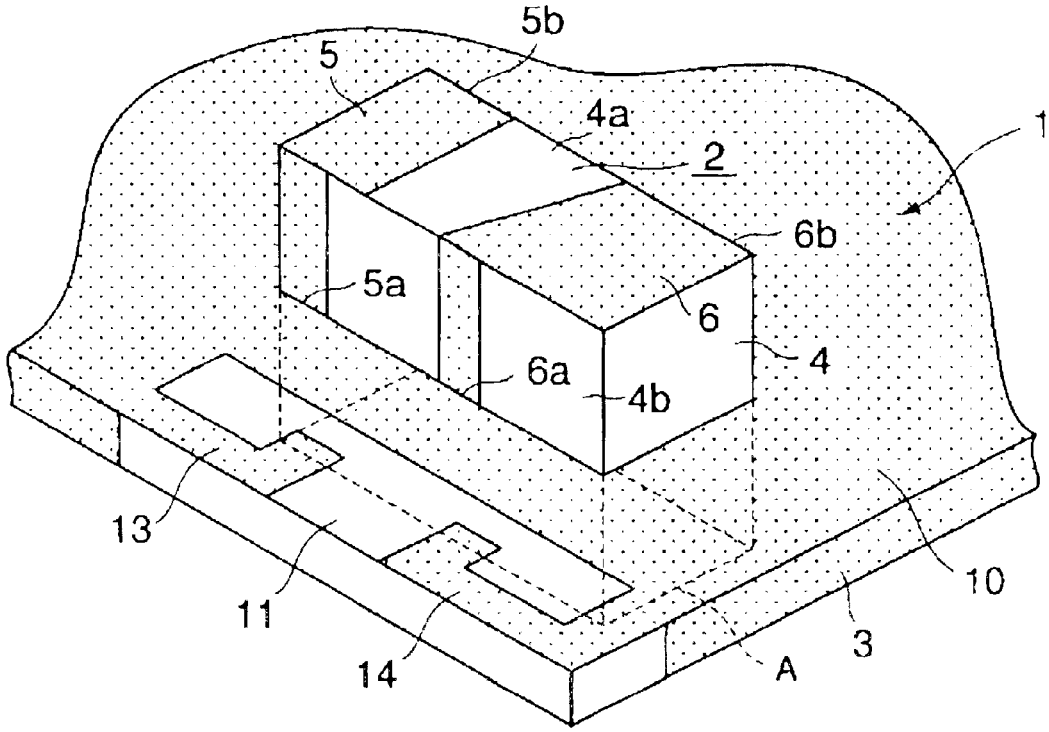
FIG. 1B is an assembly perspective view of the antenna unit according to the first and second preferred embodiments of the present invention.
Figure 2:
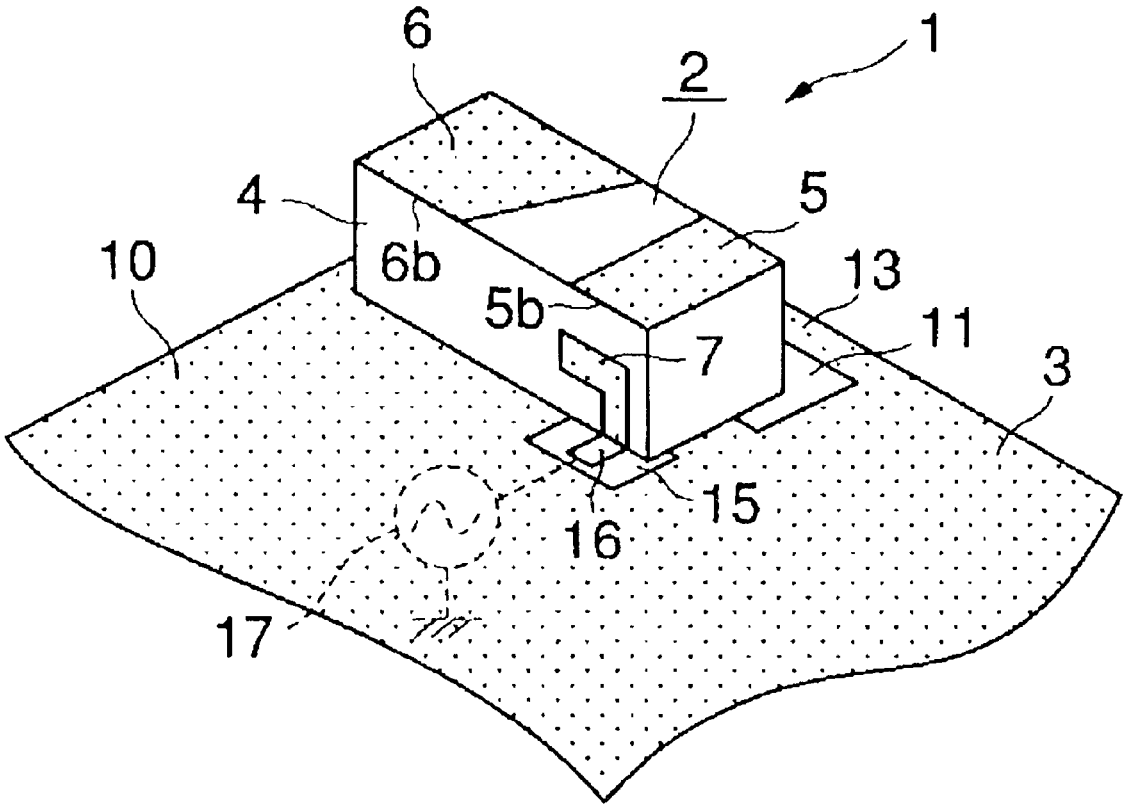
FIG. 2 is a perspective view of the antenna unit shown in FIGS. 1A and 1B, the perspective view showing the rear of the antenna unit.

FIG. 1A is a perspective view of an antenna unit 1 according to a first preferred embodiment of the present invention. FIG. 1B is a schematic assembly view of the antenna unit 1. FIG. 2 shows the rear of the antenna unit 1 shown in FIGS. 1A and 1B.

Figure 3:
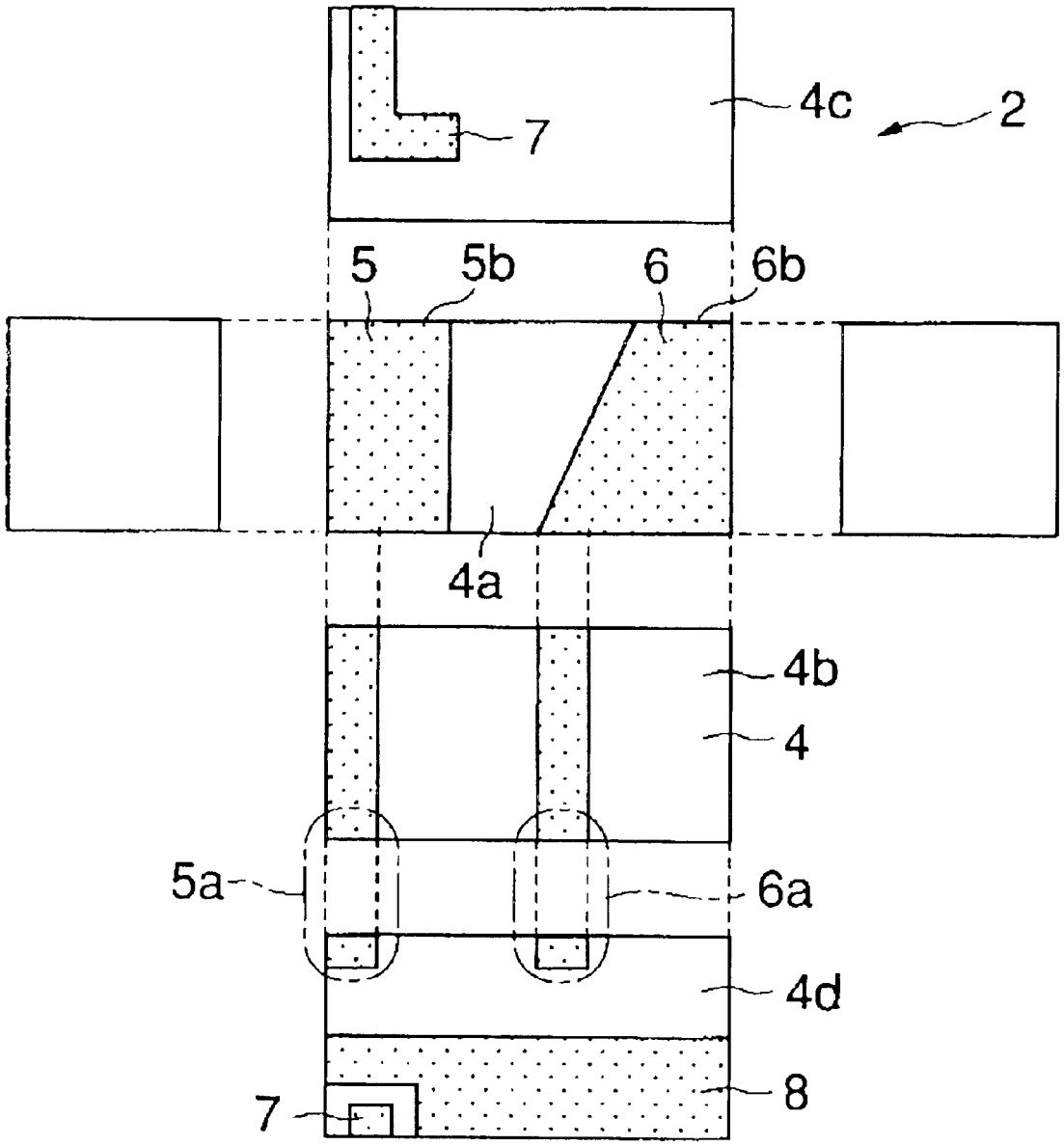
FIG. 3 is a developed view of an antenna body defining the antenna unit shown in FIGS. 1A and 1B.

The antenna unit 1 includes a chip-shaped antenna body 2 and a circuit substrate 3 for mounting the antenna body 2 thereon. FIG. 3 is a developed view of the antenna body 2.

The antenna body 2 includes a dielectric substrate 4 and a fed radiation electrode 5, a non-fed radiation electrode 6, a feed electrode 7, and a ground electrode 8 that are disposed on the dielectric substrate 4. More specifically, the fed radiation electrode 5 and the non-fed radiation electrode 6 are arranged so as to be adjacent to each other over a predetermined distance on an upper surface 4*a* of the dielectric substrate 4. The fed radiation electrode 5 has an end 5*a* and the non-fed radiation electrode 6 has an end 6*a*. These ends 5*a* and 6*a* extend from the upper surface 4*a* to a lower surface 4*d* via a side surface 4*b* and function as grounding ends. The other end of the fed radiation electrode 5 is an open end 5*b* and that of the non-fed radiation electrode 6 is an open end 6*b*. The open end 5*b* functions as a feed end.

The feed electrode 7 is disposed on a side surface 4*c* of the dielectric substrate 4 so as to face the feed end 5*b* over a predetermined distance. An external connection end of the feed electrode 7 extends to the lower surface 4*d*. The ground electrode 8 is arranged on the lower surface 4*d* in an area where the grounding ends 5*a* and 6*a* and the external connection end of the feed electrode 7 are not located.

A ground electrode 10 is arranged on the circuit substrate 3 though it does not cover the entire surface of the circuit substrate 3. That is to say, a portion where the ground electrode 10 is not located (hereinafter referred to as a ground-electrodeless portion 11) is provided on the circuit substrate 3. This ground-electrodeless portion 11 extends from a predetermined portion of an area A for mounting the antenna body 2 thereon (hereinafter referred to as an antenna-body mounting area A) to the edge portion of the circuit substrate 3.

In this preferred embodiment, grounding lines 13 and 14 for connecting the grounding ends 5*a* and 6*a* to the ground electrode 10, respectively, are disposed on the ground-electrodeless portion 11.

Further, a ground-electrodeless portion 15 is provided on the circuit substrate 3 and a feeding land trace 16 is disposed on the ground-electrodeless portion 15, as shown in FIG. 2. This feeding land trace 16 is connected to a signal feeder 17.

In this antenna unit 1, the external connection end of the feed electrode 7 is connected to the feeding land trace 16 and the grounding end 5*a* is connected to the grounding line 13 on the feed side. Further, the grounding end 6*a* is connected to the grounding line 14 on the non-feed side. In this manner, the antenna body 2 is mounted on the circuit substrate 3.

In this antenna unit 1, for example, when a signal for communications is transmitted from the signal feeder 17 to the feed electrode 7, the signal is transmitted from the feed electrode 7 to the fed radiation electrode 5 via capacitance. Further, the signal is transmitted from the fed radiation electrode 5 to the non-fed radiation electrode 6 by the electromagnetic coupling therebetween, whereby the fed radiation electrode 5 and the non-fed radiation electrode 6 resonate and perform an antenna operation. Further, in this preferred embodiment, the fed radiation electrode 5 and the non-fed radiation electrode 6 can generate a double resonance state. Therefore, the antenna unit 1 has a frequency characteristic shown in FIG. 4, which shows a return loss indicated by solid line A, and can perform radio-wave communications in two different frequency bands.

In this preferred embodiment, the grounding ends 5*a* and 6*a* are connected to the ground electrode 10 via the grounding lines 13 and 14, respectively. Therefore, currents resulting from the resonance of the fed radiation electrode 5 and the non-fed radiation electrode 6 pass through the grounding lines 13 and 14, and the grounding lines 13 and 14 perform an antenna operation in concert with the fed radiation electrode 5 and the non-fed radiation electrode 6.

In this preferred embodiment, the grounding lines 13 and 14 extend from the grounding ends 5*a* and 6*a*, respectively, and are connected to the ground electrode 10 via a predetermined area of the ground-electrodeless portion 11, the predetermined area being outside the antenna-body mounting area A. That is to say, another antenna is disposed in the area outside the antenna-body mounting area A, whereby the effective size of the antenna body 2 increases. Therefore, the efficiency of the antenna unit 1 is higher than that of the known antenna unit wherein the grounding ends 5*a* and 6*a* are directly connected to the ground electrode 10.

Further, in this preferred embodiment, the grounding lines 13 and 14 extend from the grounding ends 5*a* and 6*a*, respectively, so as to be spaced away from each other along a direction β that is approximately perpendicular to a direction α along which the currents resulting from the resonance of the fed radiation electrode 5 and the non-fed radiation electrode 6 pass. Then, the grounding lines 13 and 14 are connected to the ground electrode 10, the ground-electrodeless portion 11 extends from the antenna-body mounting area A to the edge portion of the circuit substrate 3, and portion of a side edge of the grounding line 13 and that of the grounding line 14 are disposed on the edge portion of the circuit substrate 3.

According to the above-described configuration, the antenna unit 1 has two different frequency bands H and L for communications. The frequency band H, which has frequencies that are higher than the other's, is affected by a polarized wave along the direction α (hereinafter referred to as a horizontally-polarized wave). The frequency band L, having frequencies are lower than the other's, is affected by a polarized wave along the direction β (hereinafter referred to as a vertically-polarized wave).

Figure 6A:
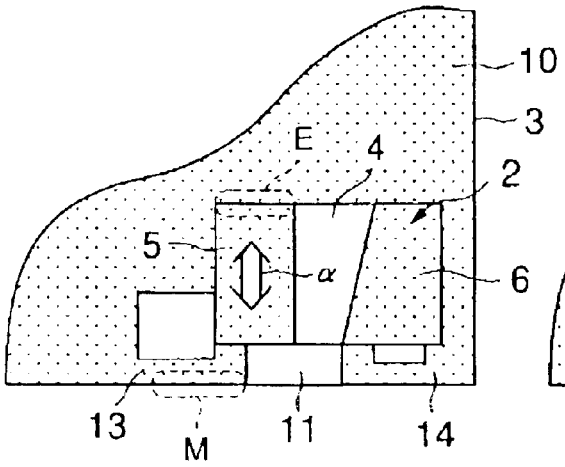
FIG. 6A shows an effect of the antenna unit of the first and second preferred embodiments of the present invention.
Figure 6B:
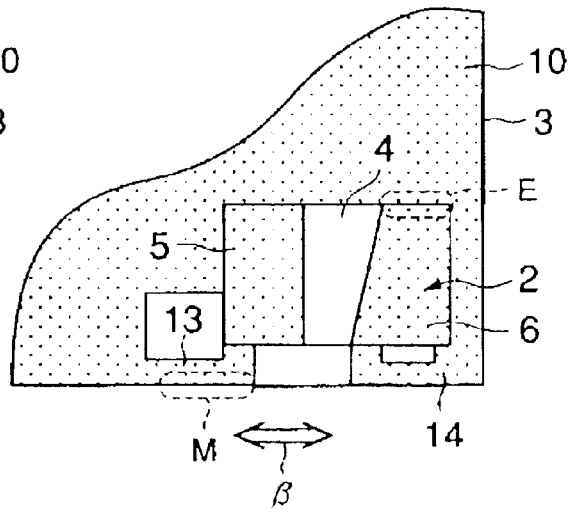
FIG. 6B shows another effect of the antenna unit of the first and second preferred embodiments of the present invention.
Figure 7A:
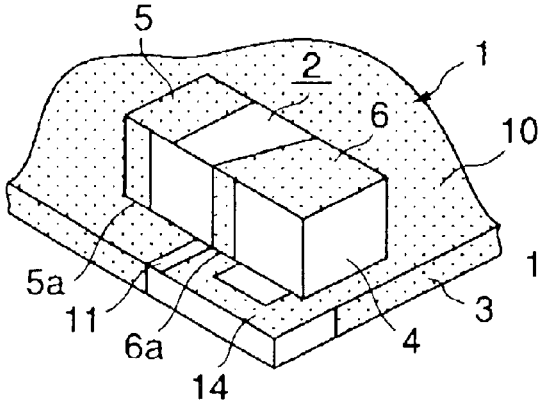
FIG. 7A shows another preferred embodiment of the present invention.
Figure 7B:
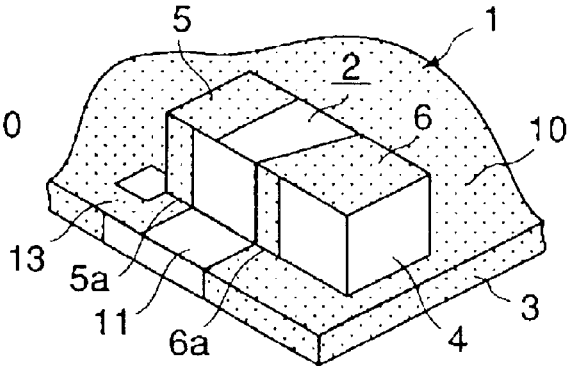
FIG. 7B shows another preferred embodiment of the present invention.

More specifically, within the frequency band H, a portion M having the strongest magnetic field exists on the grounding line 13 and a portion E having the strongest electric field exists on the feed end 5*b*, as shown in FIG. 6A. Therefore, the intensity of the horizontally-polarized wave that couples the strongest electric field portion E and the strongest magnetic field portion M becomes high. Within the frequency band L, the strongest electric field portion E exists on the open end 6*b* even though the position of the strongest magnetic field portion M is the same as in the case of the frequency band H, as shown in FIG. 6B. In this case, the currents of the grounding lines 13 and 14 are in phase. Further, the intensity of an electric field generated by the grounding line 13 and the intensity of an electric field generated by the grounding line 14 interact with each other and become high. Therefore, the intensity of the vertically-polarized wave becomes high.

Figure 5:
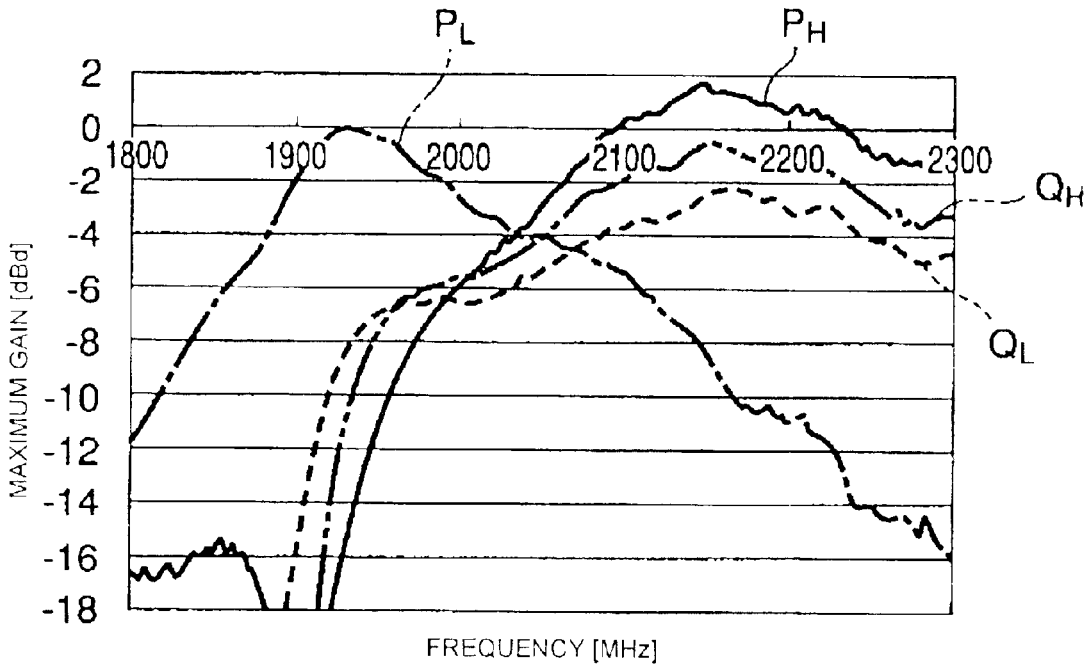
FIG. 5 is a graph showing the frequency characteristic of the antenna unit and that of a known antenna, and a comparison of the maximum gain of a horizontally-polarized wave and that of a vertically-polarized wave of the antenna unit, and the maximum gain of a horizontally-polarized wave and that of a vertically-polarized wave of the known antenna.

The above-described configuration has been confirmed by experiments performed by the inventors. The result of the experiment is shown in a graph of FIG. 5. This graph shows the frequency characteristic of the antenna unit 1 and that of the known antenna (in the case where the grounding ends of the fed radiation electrode 22 corresponding to the fed radiation electrode 5 and the non-fed radiation electrode 23 corresponding to the non-fed radiation electrode 6 are directly connected to the ground electrode 26 on the circuit substrate 25, which corresponds to the ground electrode 10). In this graph, solid line $P_H$ indicates the maximum gain of the horizontally-polarized wave of the antenna unit 1, and chain line $P_L$ indicates the maximum gain of the vertically-polarized wave of the antenna unit 1. Further, chain double-dashed line $Q_H$ indicates the maximum gain of the horizontally-polarized wave of the known antenna, and dotted line $Q_L$ indicates the maximum gain of the vertically-polarized wave.

As shown in the above, in the past, the maximum gain of the horizontally-polarized wave and the maximum gain of the vertically-polarized wave are similar to each other, as shown by the chain double-dashed line $Q_H$ and the dotted line $Q_L$. However, according to the configuration of the first preferred embodiment, the tendency of the horizontally-polarized wave and that of the vertically-polarized wave become different from each other. More specifically, the horizontally-polarized wave becomes large in the frequency band H higher than the frequency band L, as shown by the solid line $P_H$, and the vertically-polarized wave becomes large in the frequency band L, as shown by the chain line $P_L$.

Figure 4:
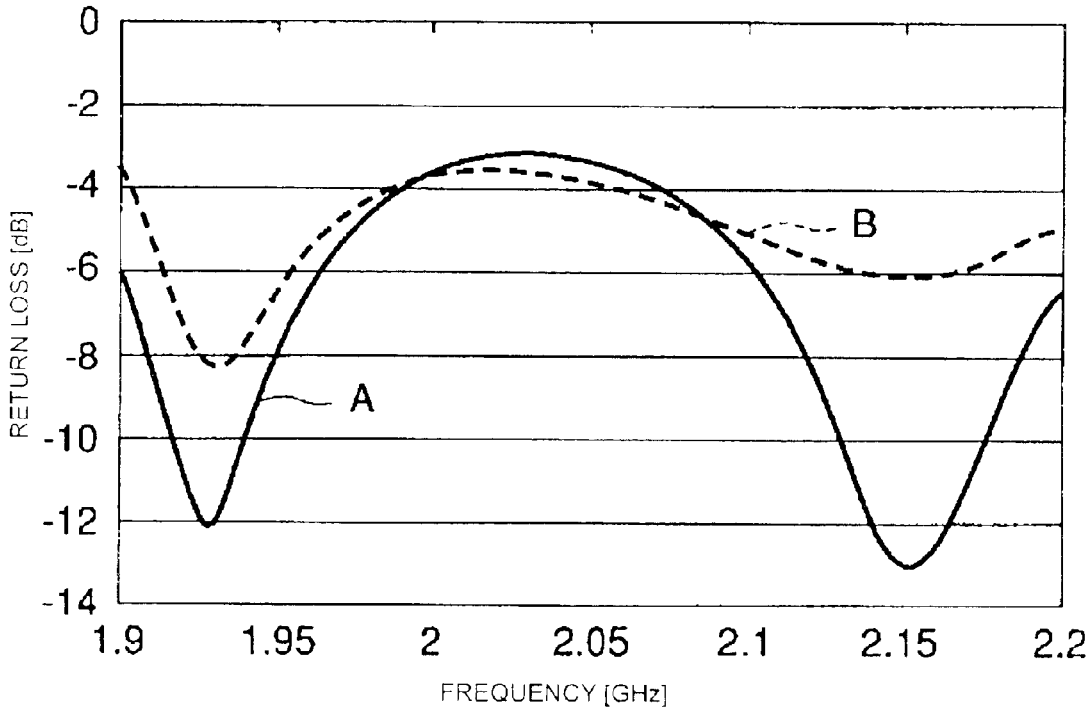
FIG. 4 is a graph showing the frequency characteristic of the antenna unit and that of a known antenna, and a comparison of an example return loss of the antenna unit and that of the known antenna.

The horizontally-polarized wave and the vertically-polarized wave are nearly perpendicular to each other and resist being affected by each other. Therefore, the antenna unit 1 of the first preferred embodiment can independently adjust the resonance frequencies within the frequency band H and those within the frequency band L. Further, it becomes easy to independently control the match between the antenna body 2 and the circuit substrate 3 within the frequency band H and that within the frequency band L. Therefore, the quality of match between the antenna body 2 and the circuit substrate 3 becomes higher than in the case of the known antenna with a return loss indicated by dashed line B of FIG. 4. Solid line A of FIG. 4 shows the return loss of the antenna unit 2 according to the frequency characteristic thereof. That is to say, the antenna efficiency increases.

Further, according to the first preferred embodiment, a portion of the antenna-body mounting area A on the circuit substrate 3 functions as the ground-electrodeless portion 11, which also increases the antenna efficiency.

As has been described, the antenna body 2 is mounted on the ground electrode 10 and the ground-electrodeless portion 11 that are disposed on the circuit substrate 3, and the grounding ends 5*a* and 6*a* are connected to the ground electrode 10 via the grounding lines 13 and 14 disposed on the predetermined area of the ground-electrodeless portion 11, the predetermined area being outside the antenna-body mounting area A. Consequently, the antenna efficiency becomes higher than in the case of the known antenna, as shown in Table 1. That is to say, it becomes easy to form the antenna body 2 that is miniaturized and low-profile without reducing the antenna efficiency.

TABLE 1

| Frequency | Antenna Efficiency [dBd] | |
|---|---|---|
| (MHz) | Known example | Embodiment |
| 1950 | −7.0 | −2.3 |
| 2110 | −1.5 | −0.7 |

A second preferred embodiment of the present invention will now be described. This preferred embodiment relates to a communication device including the antenna unit 1 of the first preferred embodiment of the present invention. Since the configuration of the antenna unit 1 has been described in the first preferred embodiment, it will not be described below. Further, the configuration of the communication device will not be described, because there are many types of communication devices that can be used for the antenna unit 1.

By using the antenna unit 1 of the first preferred embodiment, this communication device is miniaturized and has suitable antenna efficiency.

The present invention is not limited to the first and second preferred embodiments, but can be achieved in various forms. For example, in the above-described preferred embodiments, the grounding ends 5*a* and 6*a* are connected to the ground electrode 10 via the grounding lines 13 and 14, respectively. However, only one of the grounding ends 5*a* and 6*a* may be connected to the ground electrode 10 via one of the grounding lines 13 and 14, and the other may be directly connected to the ground electrode 10. In this case, the antenna efficiency also becomes higher than in the case where the known antenna is used by using either the grounding line 13 or the grounding line 14.

Figure 8:
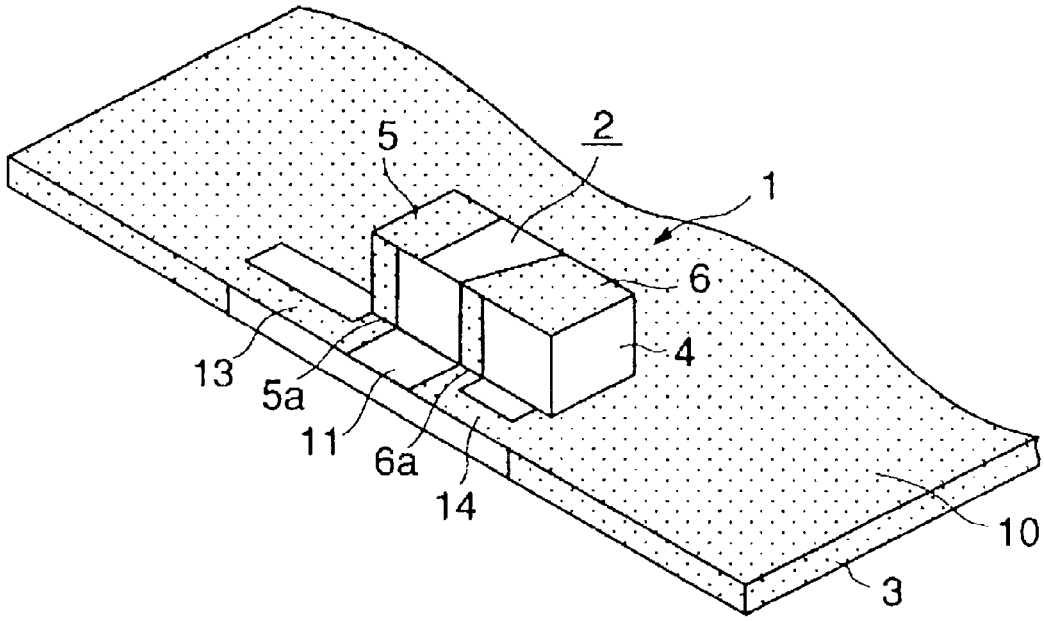
FIG. 8 shows an example position on which the antenna body is mounted.

Further, according to the above-described preferred embodiments, the antenna body 2 is mounted on one corner of the circuit substrate 3. However, the mounting position of the antenna body 2 is not limited to the above-described preferred embodiments. That is to say, the antenna body 2 may be mounted on the circuit substrate 3 at a predetermined position, such as the center portion of the edge portion thereof, the center portion thereof, and so forth, as shown in FIG. 8, considering predetermined positions the circuit substrate 3 for mounting circuit elements and traces thereon. Further, it may be arranged that at least one of the grounding lines 13 and 14 has a length that is sufficient for increasing the antenna efficiency, and the predetermined area of the ground-electrodeless portion 11 outside the antenna-body mounting area A has an area on which at least one of the grounding lines 13 and 14 can be mounted. Therefore, the ground-electrodeless portion 11 may not extend from the antenna-body mounting area A to the edge portion of the circuit substrate 3 when the antenna body 2 is mounted on the center portion of the circuit substrate 3, for example. In this case, the side edge of at least one of the grounding lines 13 and 14 is not disposed on the edge portion of the circuit substrate 3.

Figure 9:
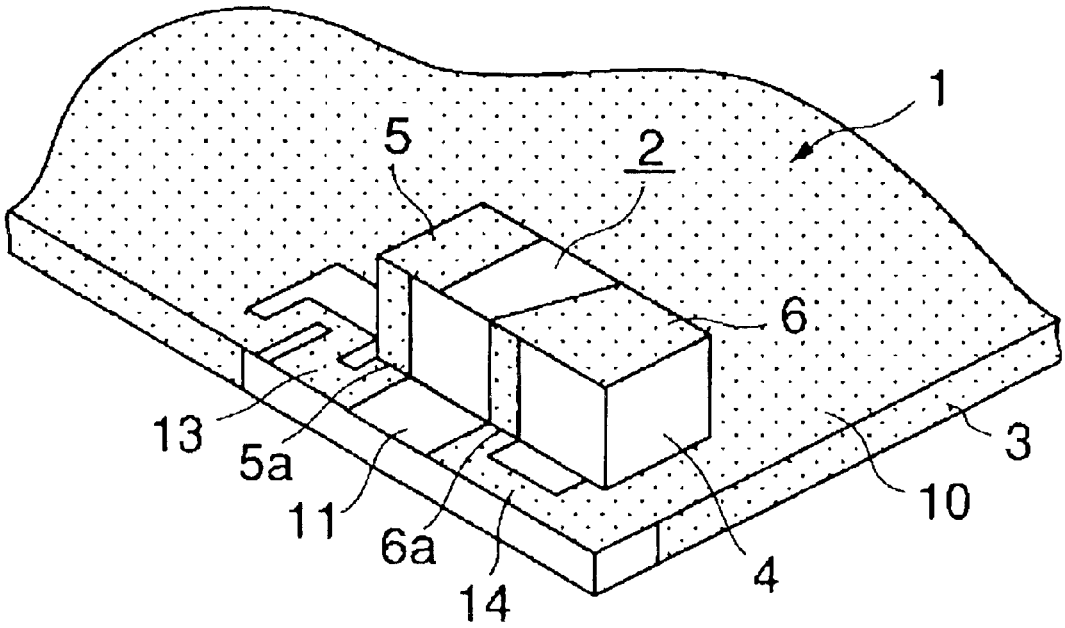
FIG. 9 shows a grounding line having a shape that is different from that in the case of the first and second preferred embodiments of the present invention.

According to the above-described preferred embodiments, the grounding lines 13 and 14 are arranged in line. However, at least one of the grounding lines 13 and 14 may have a meandering configuration, as shown in FIG. 9. In this case, the inductance of at least one of the grounding lines 13 and 14 increases, whereby the area for mounting at least one of the grounding lines 13 and 14 thereon can be reduced. Therefore, the area of the ground-electrodeless portion 11 outside the antenna-body mounting area A can be reduced.

Figure 10:
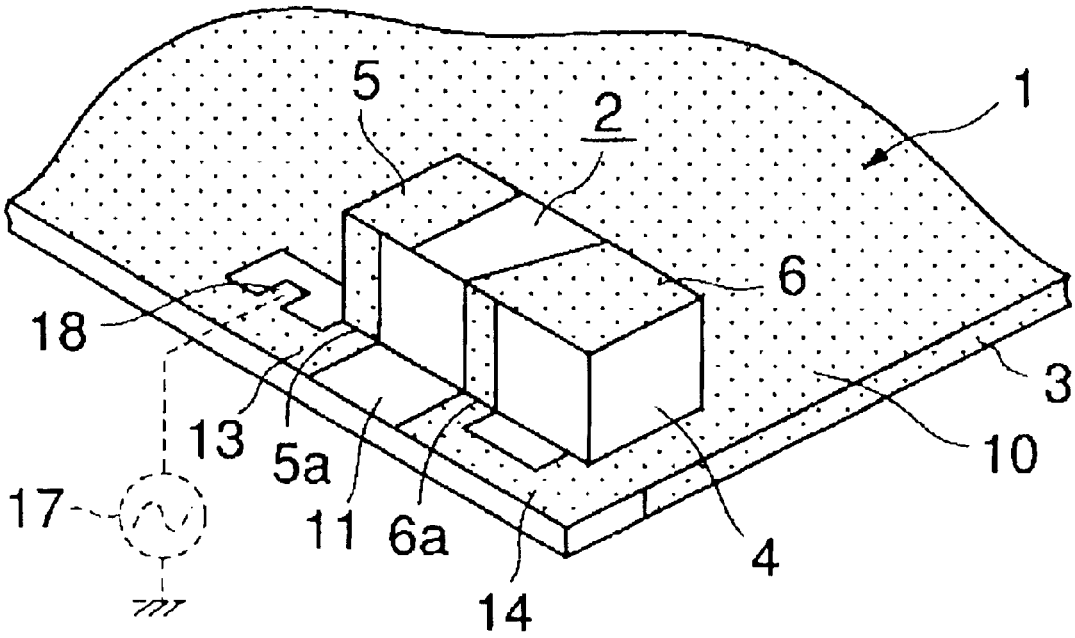
FIG. 10 shows an example antenna unit including a directly-fed radiation electrode.

In the above-described preferred embodiments, the fed radiation electrode 5 is preferably a capacitively-fed radiation electrode. That is to say, a signal is transmitted from the feed electrode 7 to the fed radiation electrode 5 via the capacitance therebetween. However, the fed radiation electrode 5 may be a directly-fed radiation electrode that receives a signal directly from the signal feeder. In this case, a signal transmitted from the signal feeder 17 is directly transmitted to the fed radiation electrode 5 via a feeding electrode 18 connected to the grounding line 13, for example, as shown in FIG. 10.

Figure 11:
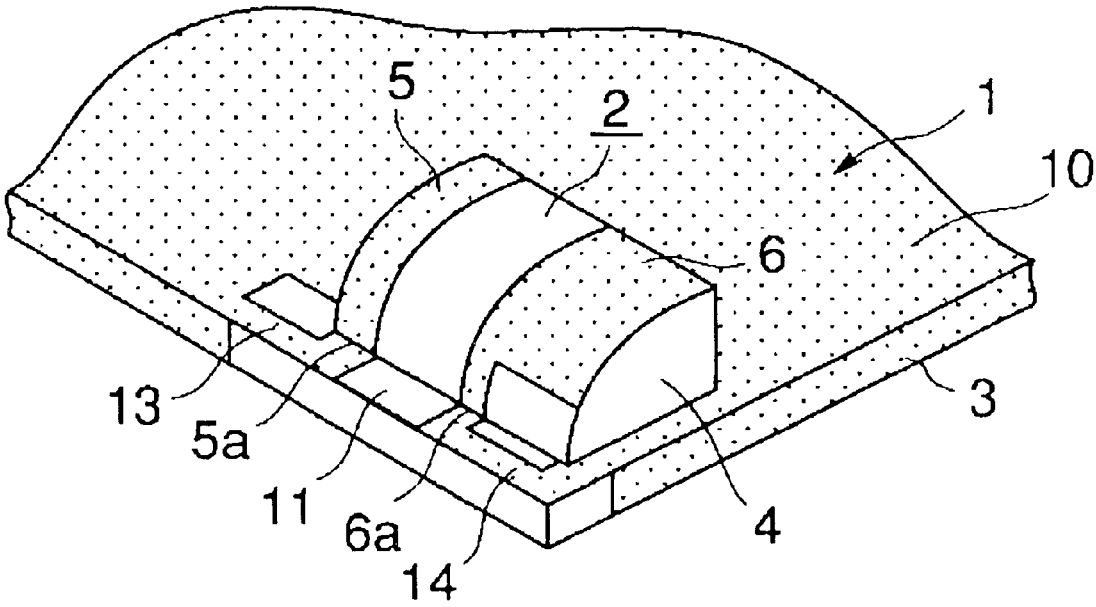
FIG. 11 shows a dielectric substrate having a shape that is different from that in the case of the first and second preferred embodiments of the present invention.
Figure 12:
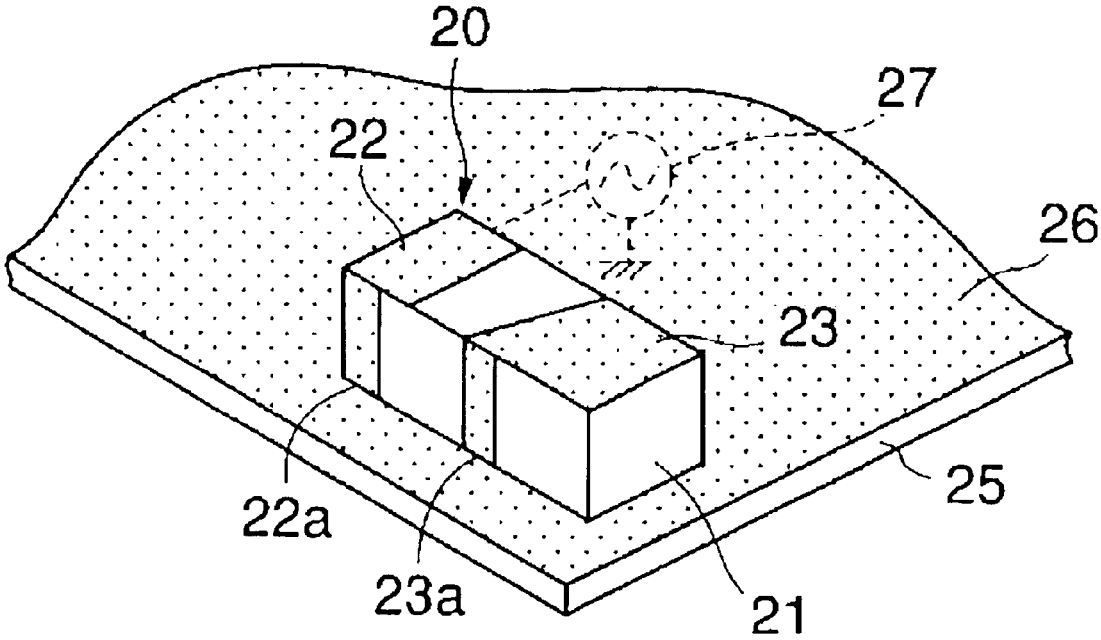
FIG. 12 PRIOR ART
FIG. 12 shows an example known antenna.

In the above-described preferred embodiments, the dielectric substrate 4 is preferably substantially rectangular. However, the fed radiation electrode 5 may have a curved surface, as shown in FIG. 11. In this case, the dielectric substrate 4 is preferably formed of a material including a resin and ceramic and molded by an insert molding method or an outsert molding method. In this manner, the dielectric substrate 4 having the curved surface can be easily formed.

In the above-described preferred embodiments, the ground electrode 8 is disposed on predetermined portion of the lower surface 4*d* of the dielectric substrate 4. However, the ground electrode 8 may not be formed. Further, in the above-described preferred embodiments, a portion of the antenna-body mounting area A on the circuit substrate 3 functions as the ground-electrodeless portion 11. However, the entire area of the antenna-body mounting area A may function as the ground-electrodeless portion 11.

In the above-described preferred embodiments, 1.9 GHz band and 2.1 GHz band are shown as examples of the frequency bands for communications of the antenna unit 1. However, other frequency bands for communications may be used for the antenna unit 1 according to the design of the fed radiation electrode 5 and the non-fed radiation electrode 6. Further, the shape of the fed radiation electrode 5 and the non-fed radiation electrode 6 can vary without being limited to the above-described preferred embodiments.

In the above-described preferred embodiments, the grounding lines 13 and 14 extend from the grounding ends 5*a* and 6*a* along the direction $\beta$ that is nearly perpendicular to the direction $\alpha$ and is connected to the ground electrode 10. However, the extension direction of the grounding lines 13 and 14 may not be perpendicular to the direction a as long as it crosses the direction $\alpha$.

Further, in the above-described preferred embodiments, the grounding ends 5*a* and 6*a* are disposed on the same side surface of the dielectric substrate 4. However, the grounding ends 5*a* and 6*a* may be disposed on different side surfaces of the dielectric substrate 4, such as side surfaces adjacent to each other, respectively.

It should be understood that the foregoing description is only illustrative of the present invention. Various alternatives and modifications can be devised by those skilled in the art without departing from the present invention. Accordingly, the present invention is intended to embrace all such alternatives, modifications and variances which fall within the scope of the appended claims.

What is claimed is:

1. An antenna unit for transmitting and receiving a predetermined radio wave, comprising:

an antenna body having a dielectric substrate, a fed radiation electrode with a first open end and a first grounding end, the fed radiation electrode being mounted on the dielectric substrate, and a non-fed radiation electrode with a second open end and a second grounding end, the non-fed radiation electrode being provided near the fed radiation electrode and mounted on the dielectric substrate; and a substrate having the antenna body mounted thereon, the substrate having a ground electrode thereon, a ground-electrodeless portion extending from at least one portion of an antenna-body mounting area so as to extend off of and away from the antenna-body mounting area, and at least one grounding line disposed on a predetermined area of the ground-electrodeless portion, the predetermined area being outside the antenna-body mounting area;

wherein the fed radiation electrode is fed a signal transmitted from a signal feeder and at least one of the first and second grounding ends is connected to the ground electrode via the grounding line.

2. An antenna unit according to claim 1, wherein the first and second grounding ends are connected to the ground electrode via the grounding lines, respectively, and the grounding lines extend from the first and second grounding ends so as to be spaced away from each other and are connected to the ground electrode.

3. An antenna unit according to claim 1, wherein the first and second grounding ends are disposed on a side surface of the dielectric substrate so as to be adjacent to each other over a predetermined distance, or on different side surfaces of the dielectric substrate, respectively.

4. An antenna unit according to claim 1, wherein the ground-electrodeless portion is an area extending from the antenna-body mounting area to an edge portion of the substrate and at least one portion of a side edge of the grounding line is disposed on the edge portion of the substrate.

5. An antenna unit according to claim 1, wherein the grounding line has a meandering configuration.

6. An antenna unit according to claim 1, further comprising a feed electrode that is connected to the signal feeder and that is provided on the grounding line connected to the fed radiation electrode, wherein the fed radiation electrode is directly fed a signal transmitted from the signal feeder via the feed electrode.

7. An antenna unit according to claim 1, further comprising a feed electrode connected to the signal feeder, wherein the fed radiation electrode is arranged over a predetermined distance from the feed electrode and fed a signal transmitted from the signal feeder via the feed electrode by capacitive coupling.

8. An antenna unit according to claim 1, wherein the antenna body has a chip-shaped configuration.

9. An antenna unit according to claim 1, wherein a feeding land trace is disposed on the ground-electrodeless portion and the feeding land trace is connected to a signal feeder.

10. An antenna unit according to claim 9, wherein the external connection end of the feed electrode is connected to the feeding land trace and the grounding end is connected to the grounding line on the feed side.

11. An antenna unit according to claim 10, wherein the grounding end is connected to the grounding line on the non-feed side.

12. An antenna unit according to claim 1, wherein a signal is transmitted from the fed radiation electrode to the non-fed radiation electrode by electromagnetic coupling therebetween such that the fed radiation electrode and the non-fed radiation electrode resonate and perform an antenna operation.

13. An antenna unit according to claim 1, wherein the fed radiation electrode and the non-fed radiation electrode are arranged to generate a double resonance state.

14. An antenna unit according to claim 1, wherein grounding lines extend from the grounding ends, respectively, and are connected to the ground electrode via a predetermined area of the ground-electrodeless portion, the predetermined area being outside the antenna-body mounting area.

15. An antenna unit according to claim 14, wherein the grounding lines extend from the grounding ends, respectively, so as to be spaced away from each other along a direction $\beta$ that is approximately perpendicular to a direction $\alpha$ along which the currents resulting from the resonance of the fed radiation electrode and the non-fed radiation electrode pass.

16. An antenna unit according to claim 1, wherein the ground-electrodeless portion extends from the antenna-body mounting area to the edge portion of the circuit substrate.

17. An antenna unit according to claim 14, wherein a portion of a side edge of each of the grounding lines are disposed on the edge portion of the circuit substrate.

18. An antenna unit according to claim 1, wherein the antenna unit includes two different frequency bands.

19. An antenna unit according to claim 1, wherein a portion of the antenna-body mounting area on the circuit substrate defines the ground-electrodeless portion.

20. A communication device comprising an antenna unit according to claim 1.

* * * * *